US010932587B2

(12) United States Patent
Poppe

(10) Patent No.: US 10,932,587 B2
(45) Date of Patent: Mar. 2, 2021

(54) CYLINDRICAL FOAM BODY, USE THEREOF AND METHOD FOR PRODUCING THIS

(71) Applicant: ROMERIKA NV, Willemstad (CW)

(72) Inventor: Willy Poppe, Sint-Niklaas (BE)

(73) Assignee: ROMERIKA NV, Willemstad (CW)

( * ) Notice: Subject to any disclaimer, the term of this patent is extended or adjusted under 35 U.S.C. 154(b) by 672 days.

(21) Appl. No.: 15/548,572

(22) PCT Filed: Jan. 28, 2016

(86) PCT No.: PCT/BE2016/000009

§ 371 (c)(1),
(2) Date: Aug. 3, 2017

(87) PCT Pub. No.: WO2016/123680

PCT Pub. Date: Aug. 11, 2016

(65) Prior Publication Data

US 2018/0000257 A1 Jan. 4, 2018

(30) Foreign Application Priority Data

Feb. 3, 2015 (BE) ..... 2015/5050

(51) Int. Cl.

| | |
|---|---|
| ***A47C 27/14*** | (2006.01) |
| ***A47C 27/06*** | (2006.01) |
| ***A47G 9/10*** | (2006.01) |

(52) U.S. Cl.

CPC ..... *A47C 27/142* (2013.01); *A47C 27/065* (2013.01); *A47C 27/14* (2013.01); *A47G 9/10* (2013.01); *A47G 2009/1018* (2013.01)

(58) Field of Classification Search

CPC ..... A47C 27/065; A47C 27/14; A47C 27/142; A47G 9/10; A47G 2009/1018

See application file for complete search history.

(56) References Cited

U.S. PATENT DOCUMENTS 1,296,359 A * 3/1919 Brown ..... A63D 5/00 473/64
4,070,719 A * 1/1978 Morgan ..... A47C 27/146 428/167

(Continued)

FOREIGN PATENT DOCUMENTS

| | | |
|---|---|---|
| DE | 103 06 039 A1 | 9/2004 |
| FR | 2 814 929 A1 | 4/2002 |
| WO | 2010/121333 A1 | 10/2010 |

OTHER PUBLICATIONS

International Search Report, dated Mar. 31, 2016, from corresponding PCT/BE2016/000009 application.

*Primary Examiner* — David R Hare
*Assistant Examiner* — Alexis Felix Lopez
(74) *Attorney, Agent, or Firm* — Nixon & Vanderhye

(57) ABSTRACT

Cylindrical foam body with a central cavity, whereby the foam body is formed by a curved flexible foam strip of which two opposite ends are fastened together, whereby the foam body has a height, whereby the strip 2 has a length, a height and a width, whereby after forming the foam body the longitudinal direction of the strip 2 is the height direction of the foam body, whereby the foam body has an outside and an inside. The foam body is provided on its outside with two or more grooves that extend over the height of the foam body and which only cut into the foam body over a part of the distance between the outside and the inside.

20 Claims, 4 Drawing Sheets

(56) References Cited

U.S. PATENT DOCUMENTS

| | | | | | |
|---|---|---|---|---|---|
| 4,194,255 | A * | 3/1980 | Poppe | A47C 27/065 | 267/153 |
| 5,705,252 | A * | 1/1998 | Lea | B29C 53/265 | 428/133 |
| 6,372,076 | B1 * | 4/2002 | Ogle | A47C 27/22 | 156/254 |
| 7,174,613 | B2 * | 2/2007 | DeFranks | A47C 27/144 | 264/138 |
| 7,865,989 | B2 * | 1/2011 | Steppat | A47C 27/148 | 5/740 |
| 8,141,251 | B2 * | 3/2012 | Poppe | A47C 27/144 | 29/429 |
| 8,353,501 | B2 * | 1/2013 | Poppe | A47C 27/144 | 267/142 |
| 9,221,374 | B2 * | 12/2015 | Kolich | B60N 2/64 | |
| 9,486,387 | B2 * | 11/2016 | Crowell | A61H 15/0092 | |
| 2009/0100603 | A1 * | 4/2009 | Poppe | A47C 27/20 | 5/655.9 |
| 2009/0131234 | A1 * | 5/2009 | Dye | A61H 15/0092 | 482/132 |
| 2010/0090383 | A1 * | 4/2010 | Rawls-Meehan | A47C 31/126 | 267/145 |
| 2010/0270718 | A1 * | 10/2010 | Poppe | A47C 27/144 | 267/145 |
| 2012/0084924 | A1 * | 4/2012 | Cheng | A47G 9/10 | 5/655.9 |
| 2012/0277077 | A1 * | 11/2012 | Hsu | A63B 21/4037 | 482/142 |
| 2013/0096472 | A1 * | 4/2013 | Bertram | A61H 15/0092 | 601/120 |

* cited by examiner

CYLINDRICAL FOAM BODY, USE THEREOF AND METHOD FOR PRODUCING THIS

BACKGROUND OF THE INVENTION

The present invention relates to a cylindrical foam body, the use thereof and a method for producing such a foam body More specifically the invention is intended to be used as foam springs in mattresses and pillows. The use of essentially cylindrical curved foam strips to act as a spring in a mattress or pillow is well known, for example in WO 2010/121333.

The market share of such foam springs for use in mattresses and similar is increasing, at the expense of steel springs, on account of the greater durability and better comfort.

Such foam springs are generally made of flexible polyurethane foams, including cold foams and viscoelastic foams, but now and again also latex foam.

The best foam springs are made from strips cut from foam blocks that are produced in a continuous casting process, called 'slabstock' blocks, whereby the strips are bent around and the ends are glued together. Strips are hereby cut through in various places so that passages occur in the wall of the foam spring. The bending around creates a stress in the foam spring that turns out to be essential for good spring characteristics.

Attempts to form foam springs in another way, for example in a mould or by cutting from foam blocks, have only had limited success. The springs have too low a load bearing capacity for the application and such a production method is expensive and yields a lot of waste.

However, disadvantages of known foam springs under bending stress are:

- because the foam is cut through in a number of places, it loses a lot of its load bearing capacity and a foam with a relatively high density must be used. This is relatively expensive and of course leads to a relatively heavy end product;
- a certain width of a foam strip yields a foam spring of a certain diameter, irrespective of the quantity and size of the cuts. This means that the diameter of the foam spring can only be adjusted by adapting the size of the foam strip, which is laborious and goes against easy automated production with a limited stock of raw materials.

It would be theoretically optimum to be able to bend a non-perforated foam strip around into a foam spring. However, this has the drawback that it creates such high internal stresses in parts of the foam spring.

For example, a foam strip of 190 mm and a height of 30 mm will have to stretch approximately 70% on its outside if its ends are to be glued together.

This means that the foam structure formed will deform: firstly the inside of the foam spring can be compressed in an uncontrolled and irreproducible way due to the stress on the outside, so that a variable irreproducible result is obtained.

Secondly the foam spring is not homogeneous: at the location of the adhesive it has a different structure than in other places. As a result of the stress on the outside, a drop-shaped cross-section will be obtained instead of the desired round cross-section.

SUMMARY OF THE INVENTION

The purpose of the present invention is to provide a solution to the aforementioned and other disadvantages, by providing a cylindrical foam body with a central cavity, whereby the foam body is formed by a curved, and thus under bending stress, flexible foam strip of which two opposite ends are fastened together, whereby the foam body has a height, whereby the strip has a length, a height and a width, whereby the longitudinal direction of the strip, after forming the foam body, is the height direction of the foam body, whereby the foam body has an outside and an inside, whereby the foam body is provided on its outside with two or more grooves that extend over the height of the foam body and which only cut into the foam body over a part of the distance between the outside and the inside.

This has the advantage that only limited stresses occur on the outside of the foam body because the grooves open up and as a result the necessary stretching on the outside of the foam body is reduced, so that the above-mentioned deformation does not occur or only to a limited extent.

It is however important that a certain bending stress remains in order to provide strength and stability to the foam body.

Such a foam body can then be used as a foam spring in mattresses, cushions and pillows.

Such a foam body can also be produced without waste being generated: all, or practically all, of the foam in the strip is used, and is also effectively used to provide the load bearing capacity and elasticity in the application.

A further advantage is that foam bodies of different diameters can be produced from a foam strip of certain dimensions, by adjusting the number, and to a lesser extent the depth, of the grooves which makes industrial production cheaper.

Springs of different hardness can also be made from a foam strip of certain dimensions and of a certain quality by adjusting the depth, and to a lesser extent the number, of the grooves.

In a preferred embodiment, before the foam body is formed, the flexible foam strip is provided with cuts, in other words incisions, that extend over one length distance of the strip, which corresponds to the full height of the foam body, whereby after formation of the foam body the incisions form the grooves in the foam body.

In this way no waste foam is formed which is attractive from cost and environmental considerations. It is also easy to make the cuts with a simple tool.

In another preferred embodiment, before the foam body is formed, the flexible foam strip is provided with milled grooves that extend over a length distance of the strip that corresponds to the full height of the foam body, whereby the grooves in the foam strip form the grooves in the foam body after formation of the foam body.

The advantage of this is that the end of the grooves in the foam strip can be rounded, and generally will be because a foam cutter simply cannot, or only with extreme difficulty, be made thin, such that the risk of tear initiation during or after bending around in these places is reduced.

Hereby some cutting residues are indeed generated, but this is not to be considered as waste, because this is material that is removed from the corners of the teeth between the grooves, whereby this material does not provide any useful contribution to the elastic properties of the foam body, so that this cannot be considered as a waste of raw materials.

In a further preferred embodiment, before the foam body is formed, the flexible foam strip is provided with a regular wave pattern that is made over the entire surface of the strip, whereby the waves extend essentially perpendicular to the longitudinal direction of the strip and whereby the wave troughs form the grooves in the foam body after formation of the foam body.

Such a wave pattern can easily be made by a convoluter machine, which is well known in the foam processing industry, whereby two strips of foam with a wave pattern are produced simultaneously so that this is extremely advantageous from a cost point of view.

In preferred embodiments the number of the said grooves in the foam body is six or more, and preferably eight or more. This better enables a cylindrical form to be obtained than with a lower number of grooves.

In preferred embodiments the flexible foam strip is composed of more than one sub-strip in its longitudinal and/or transverse direction and/or height direction, thus from a number of foam strips with possible different properties connected together.

As a result the elastic behaviour can be varied.

The invention further concerns the use of a foam body according to the invention as a spring in a mattress or pillow. Hereby the springs are used with their height direction in the direction in which the greatest force is exerted during use of the mattress or pillow, normally the vertical direction.

Furthermore, the invention concerns a method for making a cylindrical foam body that comprises the following steps in order:

A: a flexible foam strip is provided with cuts, grooves or a wave pattern;

B: the flexible foam strip is bent around and two ends of the strip are connected together to fix the rounded position, whereby the axis around which the strip is curved runs entirely or essentially parallel to the cuts, grooves or wave pattern.

BRIEF DESCRIPTION OF THE DRAWINGS

With the intention of better showing the characteristics of the invention, preferred embodiments of a foam body according to the invention are described hereinafter by way of an example, without any limiting nature, with reference to the accompanying drawings, wherein.

DETAILED DESCRIPTION OF THE PREFERRED EMBODIMENTS

Figure 1:
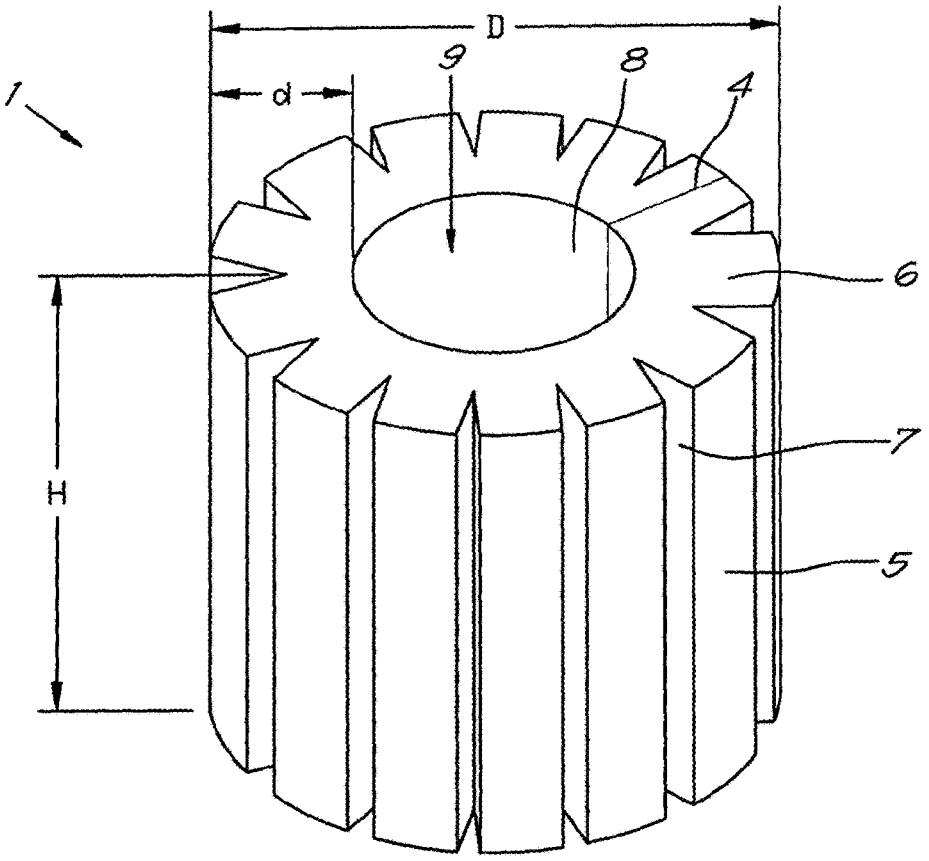
FIG. 1 schematically shows a perspective view of a foam body according to the invention.
Figure 2:
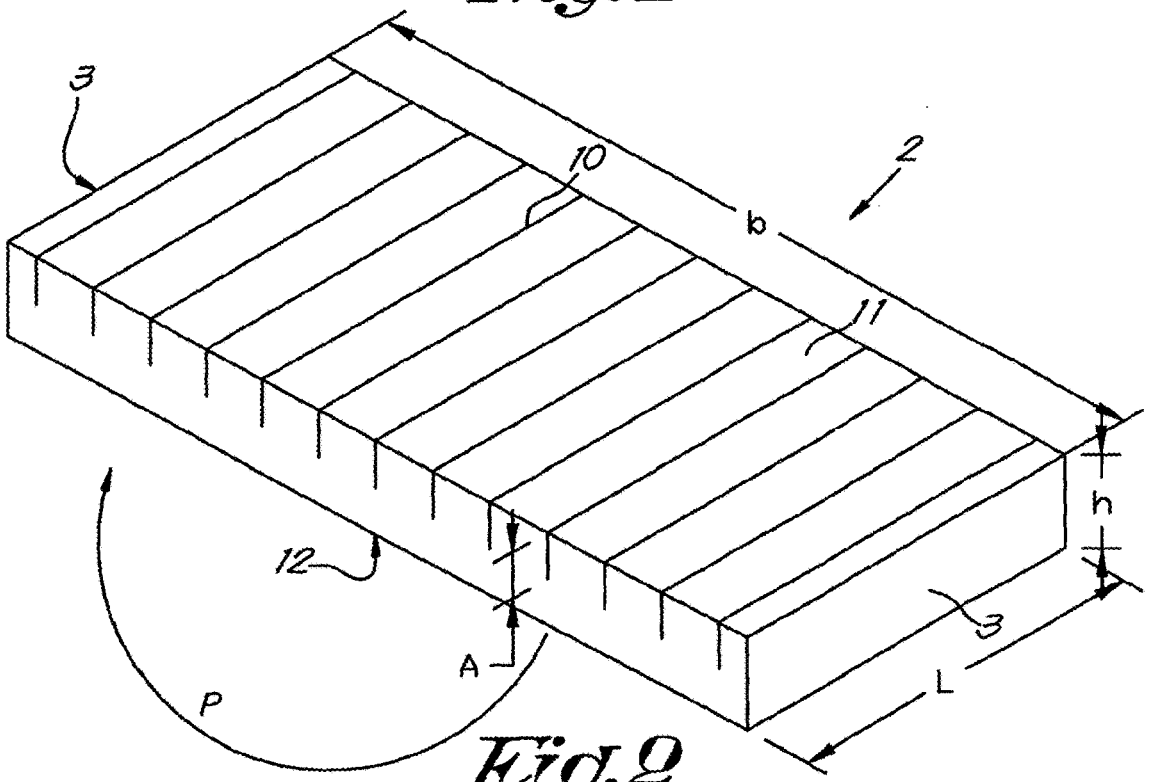
FIG. 2 shows a starting product for the production of the foam body of FIG. 1.

The foam body of FIG. 1 is formed by an essentially cylindrical curved strip of foam, as shown in FIG. 2, of which two ends 3 are glued together and thereby form an adhesive seam 4 in the foam body 1.

The foam body has a height of approximately 12 cm and a diameter of approximately 10.5 cm. The wall thickness is approximately 2.5 cm.

On the outside 5 of the foam body 1, the foam body 1 is provided with thirteen teeth 6 and grooves 7, which in this example are V-shaped and which extend parallel to the height direction H over the entire height H.

The inside 6 of the foam body 1 defines a central cavity 9 in the foam body 1.

On account of the fact that it is under bending stress, such a foam body 1 is highly suitable for use as a foam spring to accommodate forces in the vertical direction.

A mattress can be formed, for example, by tens to hundreds of such foam bodies 1 placed next to one another and provided with a covering layer.

Such a foam body 1 can be produced very easily by taking a rectangular strip 2 of flexible polyurethane foam with a height h of 2.5 cm, a width b of 18 cm and a length L of 12 cm, as shown in FIG. 2, and providing this with thirteen cuts 10 at a regular distance from one another that each run over the entire length L and which have a depth A of 15 cm from the top surface 11 and which do not cut through the strip 2 down to the bottom surface 12.

Such cuts 10 can be made using rotating blades for example.

Hereby to prevent confusion it is noted that in this example the dimension of the strip 2 that is indicated as the width b is greater than the dimension that is indicated as the length L.

The strip 2 is then bent around in the longitudinal direction L as indicated by the arrow P, after which the two ends 3 of the strip 2 are glued together.

Hereby the cuts 10 in the strip 2 are pulled open into grooves 7 and the foam body 1 thus formed. As a result they enable the foam body 1 to be formed without the foam being significantly compressed on the inside 8 and without the adhesive seam 4 resulting in a significant deformation of the foam body 1.

Alternatively, such a foam body 1 can be produced continuously by unrolling a foam strip 2 rolled-up in the transverse direction b, then by guiding it through a cutting device in which the strip 2 is provided with cuts in the longitudinal direction L, then by guiding it through a bending device and a gluing device in which the strip 2 is bent around in the longitudinal direction L and the sides are glued together to form a tube structure, from which pieces can finally be cut off that correspond to the desired height H of the foam body 1.

Figure 3:
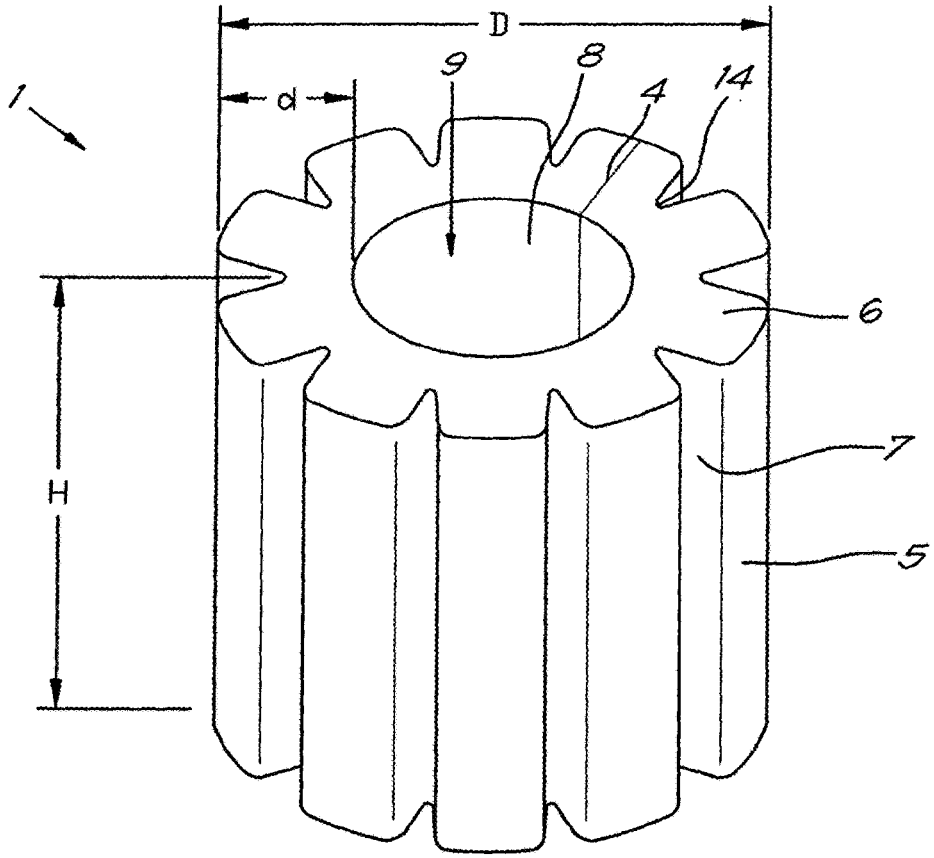
FIG. 3 schematically shows a perspective view of an alternative foam body according to the invention.
Figure 4:
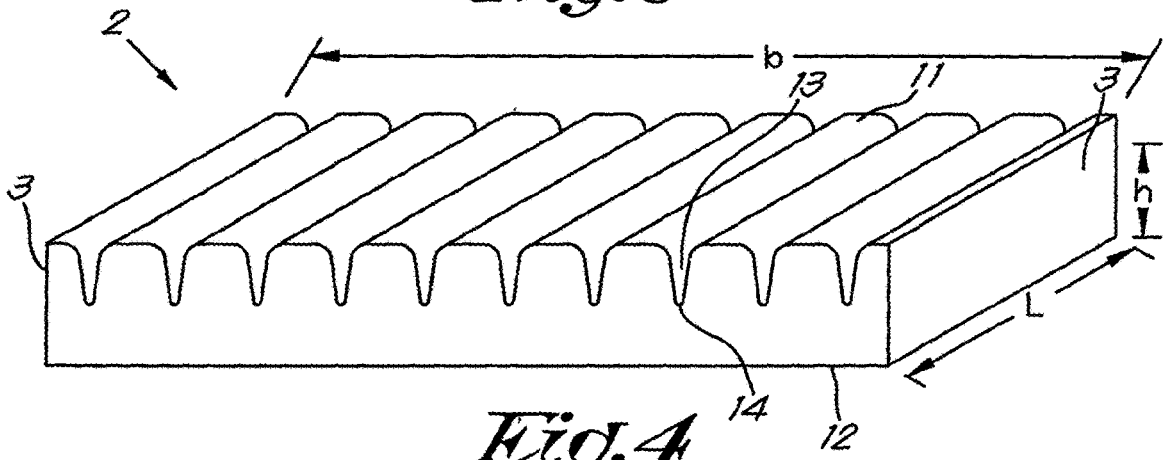
FIG. 4 shows a starting product for the production of the foam body of FIG. 3.

The alternative foam body 1 illustrated in FIG. 3 and the foam strip illustrated in FIG. 4, differ from the embodiment of FIGS. 1 and 2 by the strip being provided with grooves 13 instead of cuts 10. These grooves 13 have a rounded end 14. Hereby the number of grooves 14 is ten.

When being bent around into a foam body the grooves 13 in the foam strip 2 become substantially wider until they form grooves 7 in the foam body 1. The rounded end 14 of the grooves 7 reduces the risk of tear formation, which is the largest at this location in the formed foam body 1.

Figure 5:
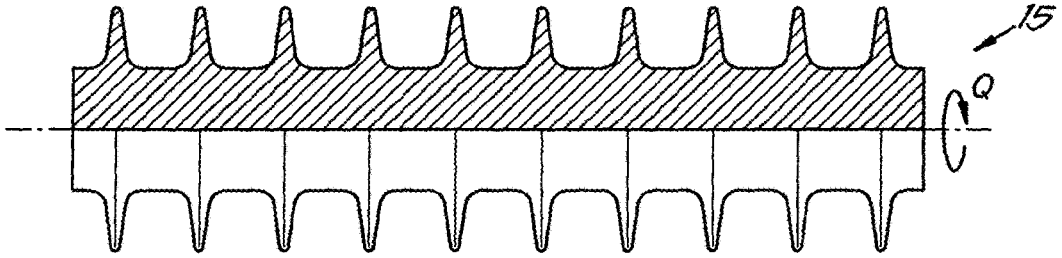
FIG. 5 shows a partial side view and a partial cross-section of a tool for producing the starting product of FIG. 4.

Such a foam strip 2 can easily be produced by guiding an unprocessed foam strip under a foam cutter 15 that rotates in the direction of arrow Q as shown in FIG. 5.

Figure 6:
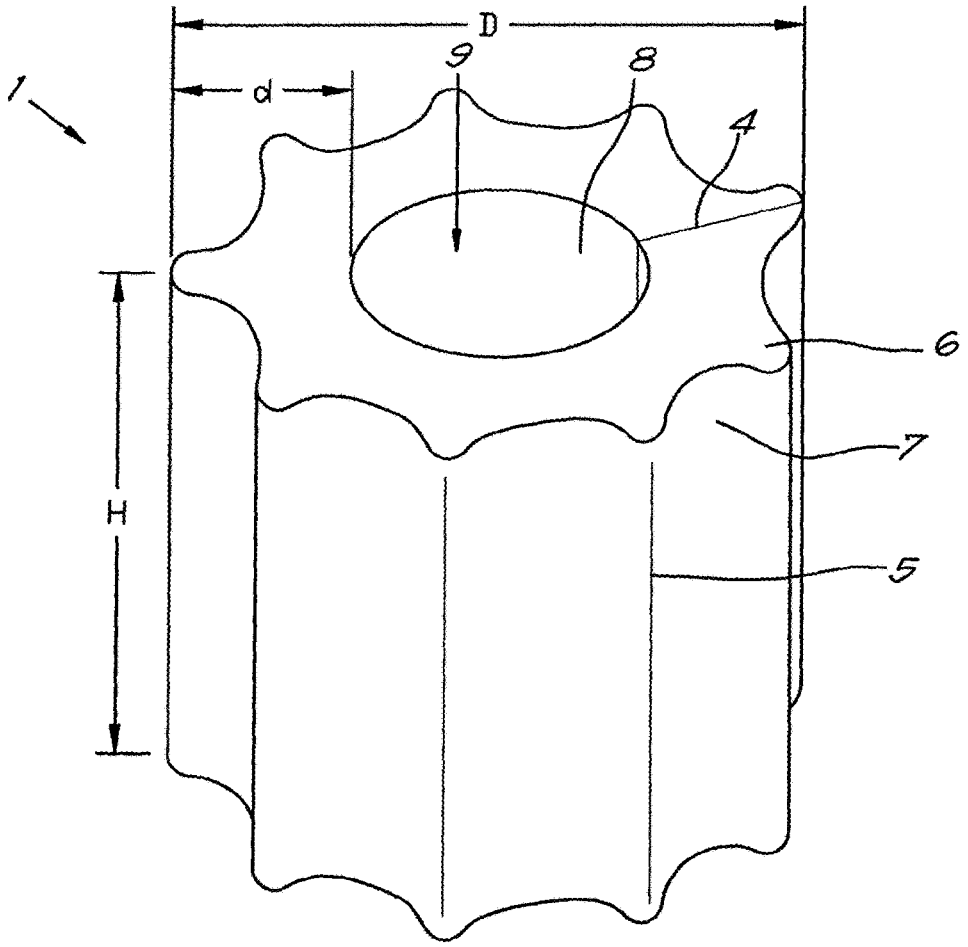
FIG. 6 schematically shows a perspective view of another alternative foam body according to the invention.
Figure 7:
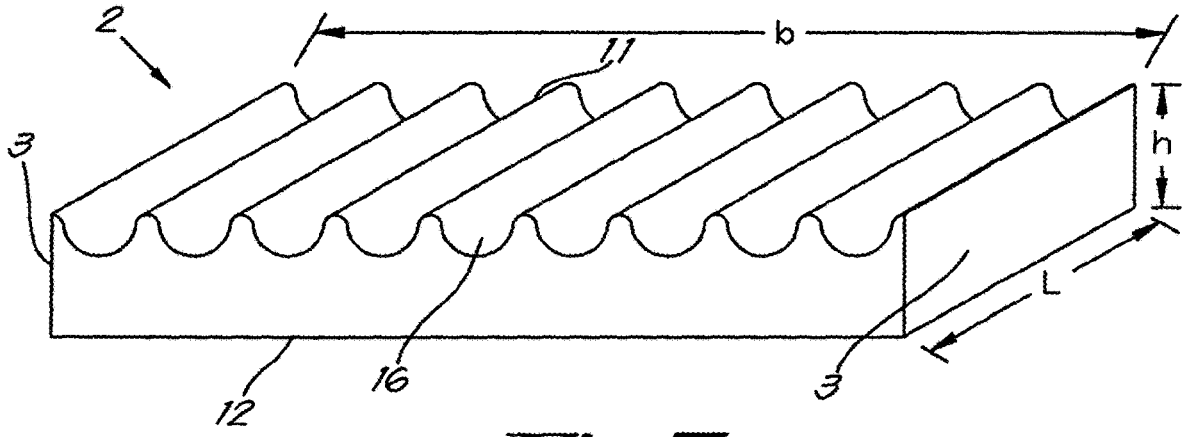
FIG. 7 shows a starting product for the production of the foam body of FIG. 6.

The alternative foam body 1 illustrated in FIG. 6 and the foam strip 2 illustrated in FIG. 7, differ from the embodiment of FIGS. 1 and 2 by the strip 2 being provided with a wave pattern that is made with a convoluter machine.

In such a machine foam is guided between toothed rollers, which compress the foam or not depending on the location, and cut in this position in the longitudinal direction, so that differences in height occur between parts of the foam that were compressed when they were cut and parts that were not compressed when they were cut.

The number of wave troughs 16 in the wave pattern is nine in this example.

When being bent around into a foam body 1 the wave troughs 16 in the foam strip become substantially wider until they form the grooves 16 in the foam body 1.

In order to obtain a foam spring with an equal diameter D to the above two embodiments, in this embodiment the length L of the strip 2 has to be taken to be ten to twenty % greater.

It will be clear that the elastic properties of the foam body 1 can be easily adjusted, of course by adjusting the nature of the foam, but also by adjusting the depth A, the number and form of the cuts 10, grooves 13 and wave troughs 16.

Figure 8:
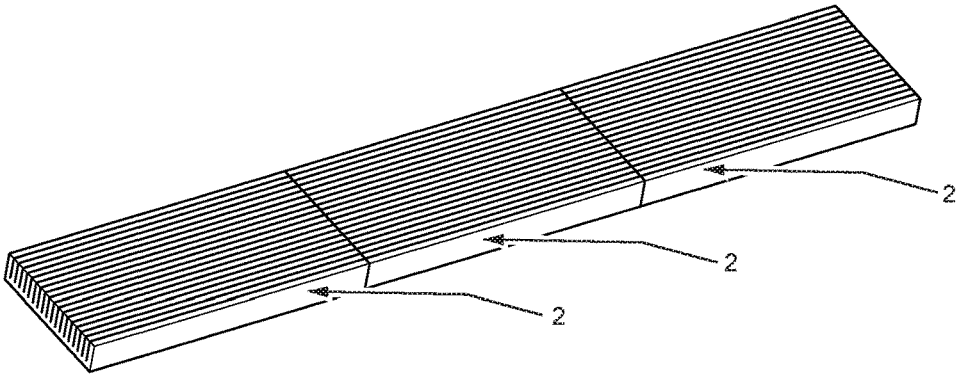
FIG. 8 shows a flexible foam strip composed of more than one sub-strip in its longitudinal direction.
Figure 9:
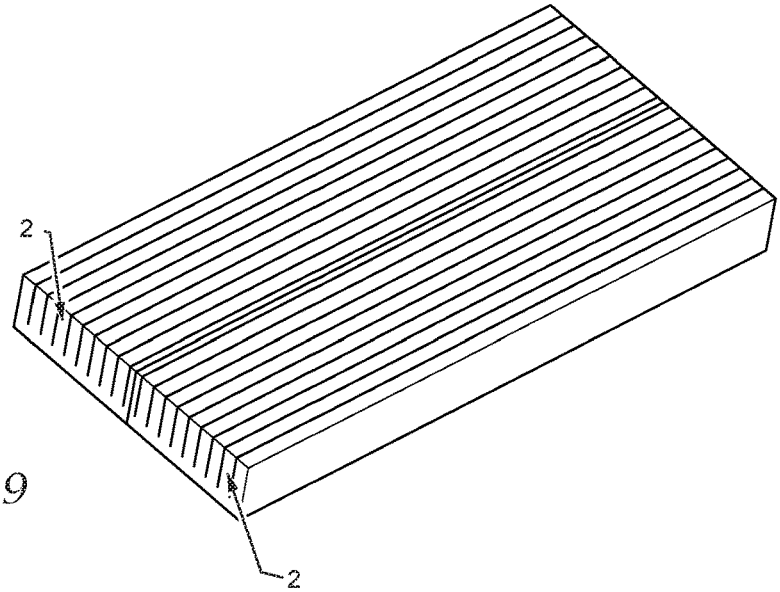
FIG. 9 shows a flexible foam strip composed of more than one sub-strip in its transverse direction.
Figure 10:
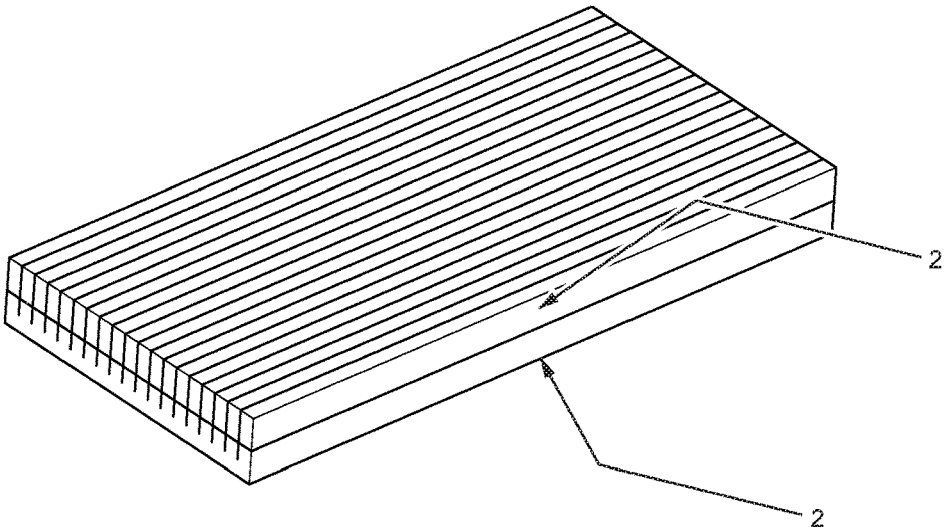
FIG. 10 shows a flexible foam strip composed of more than one sub-strip in its height direction.

As shown in FIGS. 8-10, the flexible foam strip may be composed of more than one sub-strip in its longitudinal direction (FIG. 8), its transverse direction (FIG. 9) or its height direction (FIG. 10).

The present invention is by no means limited to the embodiment described as an example and shown in the drawings, but a foam body according to the invention can be realised in all kinds of forms and dimensions, without departing from the scope of the invention.

The invention claimed is:

1. A cylindrical foam body (1) with a central cavity (9), the foam body (1) formed by a curved flexible foam strip (2) of which two opposite ends (3) are fastened together, whereby the foam body is defined by a first height (H) in a height direction, and the foam strip (2) has a length (L) in a longitudinal direction, a second height (h), and a width (b), whereby after forming the foam body (1), the longitudinal direction of the foam strip (2) is the height direction of the foam body (1), and the foam body (1) has an outside (5) and an inside (8), wherein the foam body (1) is provided on the outside (5) with two or more grooves (7) that each extend over an entirety of the first height (H) of the foam body (1) and which only cut into the foam body (1) over a part of a distance between the outside (5) and the inside (8).

2. The foam body according to claim 1, wherein before forming the foam body (1), the flexible foam strip (2) is provided with cuts (13) that extend over the length (L) of the foam strip (2) that corresponds to the first height (H) of the foam body (1), whereby after formation of the foam body (1) the cuts (13) form the grooves (7) in the foam body (1).

3. The foam body according to claim 1, wherein before forming the foam body the flexible foam strip (2) is provided with milled grooves (13) that extend over the length (L) of the foam strip (2) that corresponds to the first height (H) of the foam body (1), whereby after formation of the foam body (1) the grooves (13) in the foam strip (2) form the grooves (7) in the foam body (1).

4. The foam body according to claim 1, wherein before forming the foam body (1) the flexible foam strip (2) is provided with a regular wave pattern that is made over an entire surface (11) of the foam strip (2), whereby the waves of the wave pattern extend essentially perpendicular to the longitudinal direction of the foam strip (2), and whereby after formation of the foam body (1) the wave troughs (16) form the grooves (7) in the foam body (1).

5. The foam body according to claim 1, wherein the number of the said grooves (7) in the foam body is six or more.

6. The foam body according to claim 1, wherein the said grooves (7) in the foam body (1) run parallel to the height direction of the foam spring (1).

7. The foam body according to claim 1, wherein the flexible foam strip (2) is composed of more than one sub-strip in the longitudinal direction.

8. The foam body according to claim 1, wherein the flexible foam strip (2) is composed of more than one sub-strip in a transverse direction (b) thereof.

9. The foam body according to claim 1, wherein the flexible foam strip (2) is composed of more than one sub-strip in a direction of the second height (h).

10. A mattress or pillow comprising a foam spring, wherein the foam spring comprises the foam body (1) according to claim 1.

11. A method for making a cylindrical foam body (1), comprising the following steps in order:

A: providing a flexible foam strip (2) with cuts (5), grooves (13) or a wave pattern, which traverse across an entire length (L) of the foam strip (2) but do not bridge a distance between a top surface (11) of the foam strip (2) and a bottom surface (12) of the foam strip (2); and B: bending the foam strip (2) around and connecting together two opposite ends (3) of the foam strip (2) to fix a rounded position whereby an axis around which the foam strip (2) is curved runs parallel to the cuts (5), grooves (13) or wave pattern.

12. The method according to claim 11, wherein the method produces a cylindrical foam body (1) with a central cavity (9), the foam body (1) formed by the flexible foam strip (2) of which the two opposite ends (3) are fastened together, whereby the foam body is defined by a second height (H) in a height direction, and the foam strip (2) has the length (L) in a longitudinal direction, the height (h), and a width (b), whereby after forming the foam body (1), the longitudinal direction (L) of the foam strip (2) is the height direction of the foam body (1), and the foam body (1) has an outside (5) and an inside (8), wherein the foam body (1) is provided on the outside (5) with two or more grooves (7) that each extend over an entirety of the second height (H) of the foam body (1) and which only cut into the foam body (1) over a part of a distance between the outside (5) and the inside (8).

13. The method according to claim 11, wherein immediately after step B the length (L) of the curved foam strip (2) is greater than a height (H) of the foam body (1), whereby after step B the foam body (1) with the height (H) is cut from the curved foam strip (2).

14. The method according to claim 11, wherein before step B the length (L) of the flexible foam strip (2) corresponds to a height (H) of the foam body (1), whereby the cuts or grooves extend over the entire length (L) of the foam strip (2) or whereby the wave pattern extends over an entire surface (11) of the foam strip (2).

15. The foam body according to claim 2, wherein before forming the foam body the flexible foam strip (2) is provided with milled grooves (13) that extend over the length (L) of the foam strip (2) that corresponds to the first height (H) of the foam body (1), whereby after formation of the foam body (1) the grooves (13) in the foam strip (2) form the grooves (7) in the foam body (1).

16. The foam body according to claim 2, wherein before forming the foam body (1) the flexible foam strip (2) is provided with a regular wave pattern that is made over an entire surface (11) of the foam strip (2), whereby the waves of the wave pattern extend essentially perpendicular to the longitudinal direction of the foam strip (2), and whereby after formation of the foam body (1) the wave troughs (16) form the grooves (7) in the foam body (1).

17. The foam body according to claim 3, wherein before forming the foam body (1) the flexible foam strip (2) is provided with a regular wave pattern that is made over an entire surface (11) of the foam strip (2), whereby the waves of the wave pattern extend essentially perpendicular to the longitudinal direction of the foam strip (2), and whereby after formation of the foam body (1) the wave troughs (16) form the grooves (7) in the foam body (1).

18. The foam body according to claim 2, wherein the number of the said grooves (7) in the foam body is six or more.

19. The foam body according to claim 3, wherein the number of the said grooves (7) in the foam body is six or more.

20. The foam body according to claim 4, wherein the number of the said grooves (7) in the foam body is six or more.

* * * * *